US008613172B2

(12) United States Patent
Olson et al.

(10) Patent No.: US 8,613,172 B2
(45) Date of Patent: Dec. 24, 2013

(54) COMPOSITE PANEL INCLUDING PRE-STRESSED CONCRETE WITH SUPPORT FRAME, AND METHOD FOR MAKING SAME

(75) Inventors: William M. Olson, Sacramento, CA (US); Glen Underwood, Elk Grove, CA (US)

(73) Assignee: Clark—Pacific Corporation, West Sacramento, CA (US)

( * ) Notice: Subject to any disclaimer, the term of this patent is extended or adjusted under 35 U.S.C. 154(b) by 0 days.

(21) Appl. No.: 13/345,407

(22) Filed: Jan. 6, 2012

(65) Prior Publication Data

US 2013/0174503 A1 Jul. 11, 2013

(51) Int. Cl.
*E04C 5/08* (2006.01)

(52) U.S. Cl.
USPC ..... 52/223.6; 52/223.1

(58) Field of Classification Search
USPC ..... 52/223.6, 223.1, 223.7, 742.14
See application file for complete search history.

(56) References Cited

U.S. PATENT DOCUMENTS

| | | | | |
|---|---|---|---|---|
| 1,375,103 | A * | 4/1921 | Needham | 52/302.3 |
| 2,271,584 | A | 2/1942 | Fellom | |
| 3,250,835 | A | 5/1966 | Kozlov | |
| 3,882,651 | A * | 5/1975 | Gilchrist | 52/223.6 |
| 5,033,248 | A * | 7/1991 | Phillips | 52/742.14 |
| 5,038,541 | A * | 8/1991 | Gibbar, Jr. | 52/295 |
| 5,074,095 | A * | 12/1991 | Wilnau | 52/745.2 |
| 5,335,472 | A * | 8/1994 | Phillips | 52/742.14 |
| 5,440,845 | A * | 8/1995 | Tadros et al. | 52/309.12 |
| 5,493,836 | A * | 2/1996 | Lopez-Munoz | 52/602 |
| 5,749,185 | A * | 5/1998 | Sorkin | 52/223.13 |
| 6,250,041 | B1 | 6/2001 | Seccombe | |
| 6,729,090 | B2 * | 5/2004 | Messenger et al. | 52/309.12 |
| 6,729,094 | B1 | 5/2004 | Spencer et al. | |
| 6,773,650 | B1 | 8/2004 | Longo | |
| 7,299,596 | B2 * | 11/2007 | Hildreth | 52/695 |
| 2006/0096202 | A1 | 5/2006 | DelZotto | |
| 2006/0230706 | A1 | 10/2006 | Skendzic et al. | |
| 2008/0127584 | A1 | 6/2008 | Schiffmann et al. | |

* cited by examiner

*Primary Examiner* — Basil Katcheves
(74) *Attorney, Agent, or Firm* — R. Michael West

(57) ABSTRACT

A composite panel comprising an elongated concrete. A plurality of elongated pre-stressed cables pass through the slab, extending from the first end to the second end. Also provided is a support frame including an upper chord and a lower chord, the upper and lower chords generally extending in parallel relation from the first end to the second end of the slab. The upper chord is adjacent the upper side of the slab and the lower chord is adjacent the lower side. A plurality of connection studs extend transversely between the upper chord and the lower chord. A plurality of anchors extend from the support frame to the pre-stressed cables, a covered portion of the anchors being cast in the concrete and an exposed portion of the anchors maintaining the support frame in generally parallel spaced relation from the inner face of the slab.

27 Claims, 6 Drawing Sheets

COMPOSITE PANEL INCLUDING PRE-STRESSED CONCRETE WITH SUPPORT FRAME, AND METHOD FOR MAKING SAME

BACKGROUND OF THE INVENTION

1. Field of the Invention

The invention relates generally to improvements in concrete panels used as exterior cladding for buildings. More specifically, the invention pertains to a composite panel, comprising a pre-stressed concrete slab structurally integrated with a support frame.

2. Description of the Prior Art

One method of constructing modern buildings employs a structural steel or cast-in place concrete supporting framework, upon which all other building elements are mounted and supported. These building elements, which are integrated with and attached to the steel or concrete supporting framework, include walls, floors, and electrical, plumbing, and HVAC systems.

The exterior of the supporting framework is covered with panels or cladding, approximately 5 to 15 feet in height, and 15 to 35 feet in length, and cementitious in nature. The panels are generally in the range of 4 to 5 inches thick, and weigh approximately 50 to 65 pounds per square foot. Typically, the cladding is cast off-site, and then transported to the construction site after the supporting framework of the building is completed. Using cranes or hoists, the cladding is lifted into place and attached to an interior building framework using fasteners. Aspects of such construction are shown and explained in U.S. Pat. No. 6,823,633, for a Secondary Moisture Drainage System For Structures Having Pre-Manufactured Exterior Cladding Systems. U.S. Pat. No. 6,823,633 is hereby specifically incorporated by reference into the present disclosure.

Owing to their durability and architectural appeal, pre-manufactured concrete cladding systems have been used extensively for exteriors of commercial buildings. In this capacity, cementitious cladding is subjected to degradation from natural forces such as wide temperature variations, moisture intrusion, ultra-violet rays, wind loading, and seismic loading. Man-made forces such as vibrations from traffic, construction within the building, and demolition and new construction in the vicinity of the building, may all contribute to weakening of the cladding over time. As a consequence, prior art cladding systems are manufactured as "heavy elements" of the overall building structure, imposing high loads on the supporting framework.

Buildings designed to carry both the lateral and the gravity loads imposed by such heavy concrete cladding systems must include additional reinforcement and upgrading of structural members, and are therefore more costly than other construction methods. It should also be noted that prior art concrete cladding systems typically require secondary interior framing to attach interior insulation and finishes. This secondary interior framing requires additional materials and labor, and also adds to the overall construction costs of the building.

It would therefore be desirable if the weight of the cladding could be reduced significantly, while still providing the inherent functional and aesthetic advantages of the cladding system. Such a reduction in weight would allow use of a supporting framework that would be less costly to design and implement. It would also be desirable if the necessity of secondary interior framework of the prior art cladding systems could be eliminated, saving again both labor and materials.

Pre-stressing concrete has long been recognized as a technique to increase the tensile strength of cast concrete structures. Through the use of a pre-stressing technique in the casting of concrete, it is possible to make a given structure stronger than a corresponding concrete structure which employs more conventional reinforcement means, such as mesh, rods, and the like. The pre-stressing technique may be used advantageously to increase the strength of poles, beams, slabs, and panels, for example.

The pre-stressing technique generally requires that high strength wires, cables, or rods, passing through the empty mold or form for the concrete structure, are pre-stressed under high tension using a calibrated tensioning fixture. Then, the concrete is poured into the mold or form, enveloping the pre-stressed wires or cables. After the concrete has sufficiently cured, the ends of the wires or cable extending outside the mold are cut from the tensioning fixture, transferring the compressive forces to the concrete through the bond between the wires or cables and the concrete.

The general principles of this technique are illustrated in U.S. Pat. No. 6,773,650, issued to Longo for a Prestressed Concrete Casting Apparatus And Method. The '650 patent illustrates a pre-stressing clamshell device designed to cast cementitious power poles. In this arrangement, a plurality of stationary, cable pre-tensioning devices are lined up at a production facility. The movable clamshell mold surrounds each pre-tensioning fixture while the concrete is poured and allowed to set. Then, the mold is opened and lifted up, and then moved along to the adjacent fixture, where the process is repeated.

In Patent Application Publication US 2006/0230706, owned by Skendzie et al., a disclosure is made of Constructing The Large-Span Self-Braced Buildings Of Composite Load-Bearing Wall-Panels And Floors. Galvanized steel sheet strips 4 are used to interconnect two concrete panels 1 in both wall and floor applications (See, FIG. 7). Two steel wire mesh layers 5 are used in conjunction with reinforcing bars 6, between the mesh layers, to reinforce the panels 1 (See, FIG. 1). In Paragraph [38] of this publication, it is stated that the reinforcing bars 6 can be replaced by pre-stressing wire-strands (not shown), depending upon the desired degree of pre-stressing. FIGS. 9 and 10 show the casting form used for manufacturing panels 1.

The general concept of interconnecting a cementitious panel to studs, through connectors embedded in a concrete panel and extending outside the panel, is also shown in the prior art. Pre-fabricated Building Panels And Method Of Manufacturing are disclosed in U.S. Pat. No. 6,729,094, granted to Spencer et al. The concrete panel 10 includes a concrete slab 11 with a metal mesh 16 embedded in the slab. An insulating panel 12 is contingent upon a surface of the concrete slab 11. One or more studs 13, having top and bottom edges secured within upper and lower U-shaped tracks 54, are interconnected to one or more connectors 17 embedded in the slab 11.

SUMMARY OF THE INVENTION

The apparatus and method disclosed herein comprise composite panels, manufactured from a pre-stressed concrete slab which is structurally integrated with a support frame. The composite panel comprises an elongated concrete slab, having a first end and a second end, an upper side and a lower side, and an outer face and an inner face defining a slab thickness. The slab further includes a plurality of elongated pre-stressed cables passing through the slab, extending from its first end to its second end. Owing to the presence of the pre-stressed cables passing through the slab, the slab can be made substantially thinner, and therefore lighter than prior art cladding slabs, while still providing the same strength and functionality.

The composite panel also comprises a support frame for interconnection to the support framework of a building or other structure. The support frame includes an upper chord and a lower chord, generally running in parallel relation to each other and extending from the first end to the second end of the slab. The upper chord is adjacent the upper side of the slab, and the lower chord is adjacent the lower side of the slab. The support frame also includes a plurality of connection studs extending transversely between the upper chord and the lower chord.

The composite panel further comprises a plurality of anchors extending from the support frame to the pre-stressed cables within the slab. A covered portion of the anchors is cast in the concrete and an exposed portion of the anchors is effective to maintain the support frame in generally parallel spaced relation from the inner face of the slab.

The support frame is spaced from the concrete slab to reduce thermal conductivity between the two structures, and to provide a degree of flexibility in accommodating differences in coefficients of thermal expansion between them. The support frame also provides support for interior finishes, so that secondary interior framing does not have to be constructed.

The combination of the pre-stressed concrete slab, the support frame, and the plurality of anchors structurally connecting and integrating the slab with the frame, products a relatively lightweight, crack resistant, and durable composite panel the provides exterior architectural appeal, and support for interior finish work.

To manufacture the composite panels, a horizontal forming surface is provided. A slab form is attached to the upper surface of the forming surface. The slab form has opposing end portions and opposing side portions, both with walls having a predetermined height generally corresponding to the thickness of the slab to be formed. The end portions of the slab form define first and second ends of the slab, and the side portions of the slab form define upper and lower sides of the slab.

At least one, but preferably a plurality of pre-stressed cables, extends across the forming surface. Ends of each cable pass through the walls of the opposing end portions of the slab form. The ends of each cable are attached to cable stressing fixtures located outside the slab form. The cables are thereby pre-stressed to a predetermined tension in anticipation of being cast in concrete.

A support frame is provided, including an upper chord and a lower chord. The upper chord and the lower chord generally extend in parallel relation from the first end to the second end of the slab to be formed. The upper chord is adjacent the upper side of the slab. and the lower chord is adjacent the lower side of the slab. A plurality of connection studs extend transversely between the upper chord and the lower chord. For additional strength, C-studs may also be provided to extend between the upper chord and the lower chord, in identical fashion.

Anchor means are provided for maintaining the support frame in generally parallel and spaced relation from the inner face of the slab to be formed. The anchor means include lateral anchors, gravity anchors, and flex anchors. Each anchor has an outer portion attached to the support frame and an inner portion in proximate relation to a respective pre-stressed cable.

After the above assembly is completed, concrete is poured into the slab form over the forming surface until the concrete generally fills the contained volume within the slab form. In doing so, all of the pre-stressed cables and the inner portions of the anchor means are completely immersed, and a cementitious slab is formed. The concrete is allowed to cure, and the pre-stressed cables extending outside the walls in the end portions of the slab form are severed. Upon removing the ends and sides of the slab form, the slab may be raised into a vertical position, where insulation may be applied to its inner surface, and further texturing and painting may be added to its outer surface.

DETAILED DESCRIPTION OF THE PREFERRED EMBODIMENT

Figure 1:
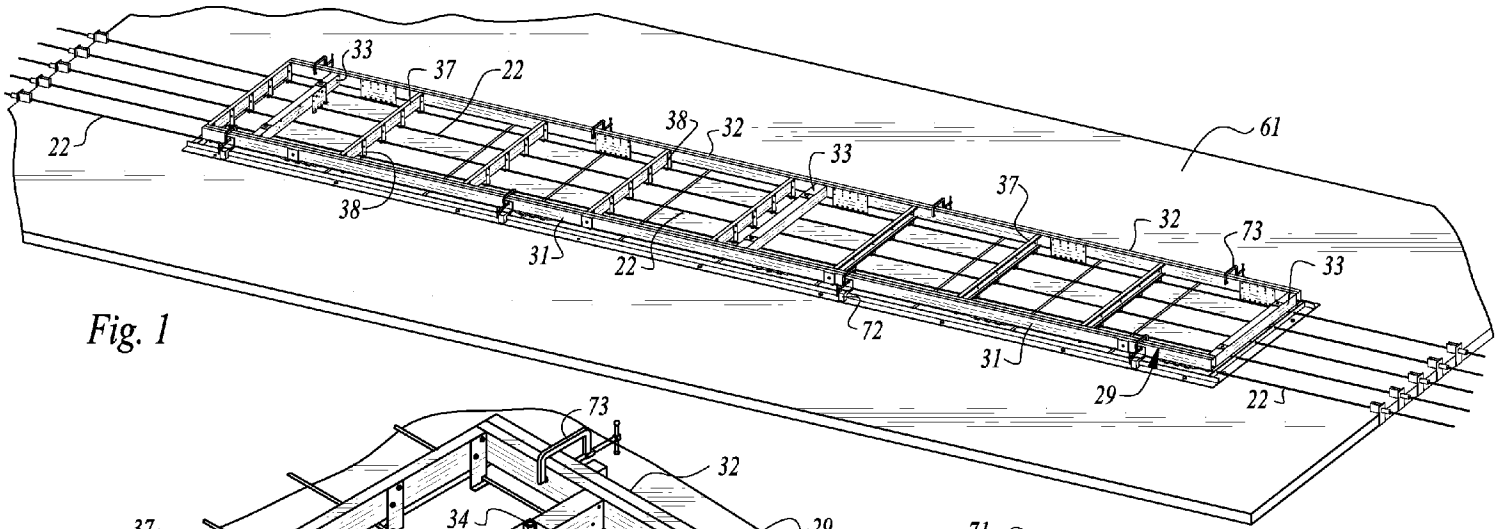
FIG. 1 is a perspective view of the forming surface, the slab form, the pre-stressed cables, the support frame, and the anchor means, all assembled in preparation for the concrete pour.
Figure 2:
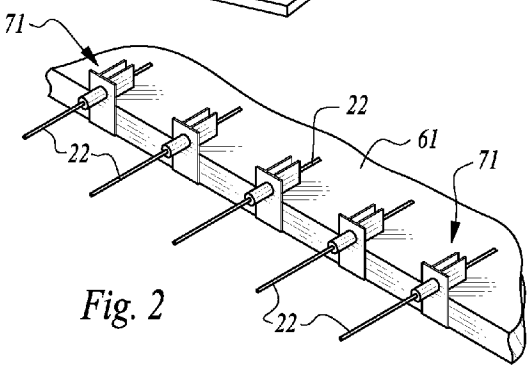
FIG. 2 is a detail perspective view of the pre-stressed cable fixtures, attached to an edge of the forming surface.
Figure 3:
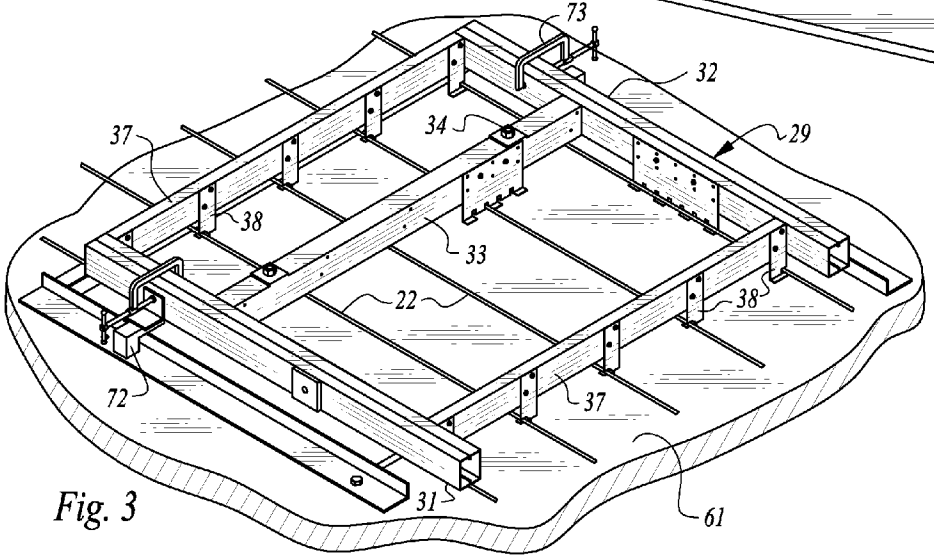
FIG. 3 is a detail perspective view of the left-hand end of the assembled structures shown in FIG. 1.

In one aspect, the composite panel 11 disclosed herein comprises an elongated concrete slab 12. Concrete slab 12 has a first end 13 and a second end 14, an upper side 16 and a lower side 17. Slab 12 further has an outer face 18 and an inner face 19 defining a thickness 21. A typical slab 12, made in accordance with the present teachings, will be on the order of 1½" to 2½" thick, from outer face 18 to inner face 19.

Slab 12 further includes at least one, but preferably a plurality of elongated pre-stressed cables 22, passing through the elongated aspect of slab 12 extending from first end 13 to second end 14. These cables 22 are preferably ¼" to ⅜" in diameter, and are pre-stressed in accordance with standard industry practice, prior to casting slab 12. The existence of such pre-stressed cables within the slab increases the slab's resilience, provides improved flexural strength, and reduces the need for control joints along the pre-stressed direction. These advantages, in turn, allow for longer spans of the relatively thin concrete slabs 12, without the need for expansion and contraction control joints. The actual tension which is placed on the cables, and the apparatus used to impose and measure the predetermined amount of tension, are all well known in the art, and need not be explained more fully herein.

The outer face 18 of the pre-stressed concrete slab may include architectural features, such as protrusions, cavities, grooves, or texturing. For example, in FIG. 10, grooves 23 and texturing 24 are shown on outer face 18. The manner in which these visual features is impressed in slab 12 will be discussed below. In addition, sandblasting outer face 18, to expose aggregate 26 through the use of a high-pressure nozzle 27 and sand particles 28, may also be employed advantageously. (See, FIG. 11).

Figure 6:
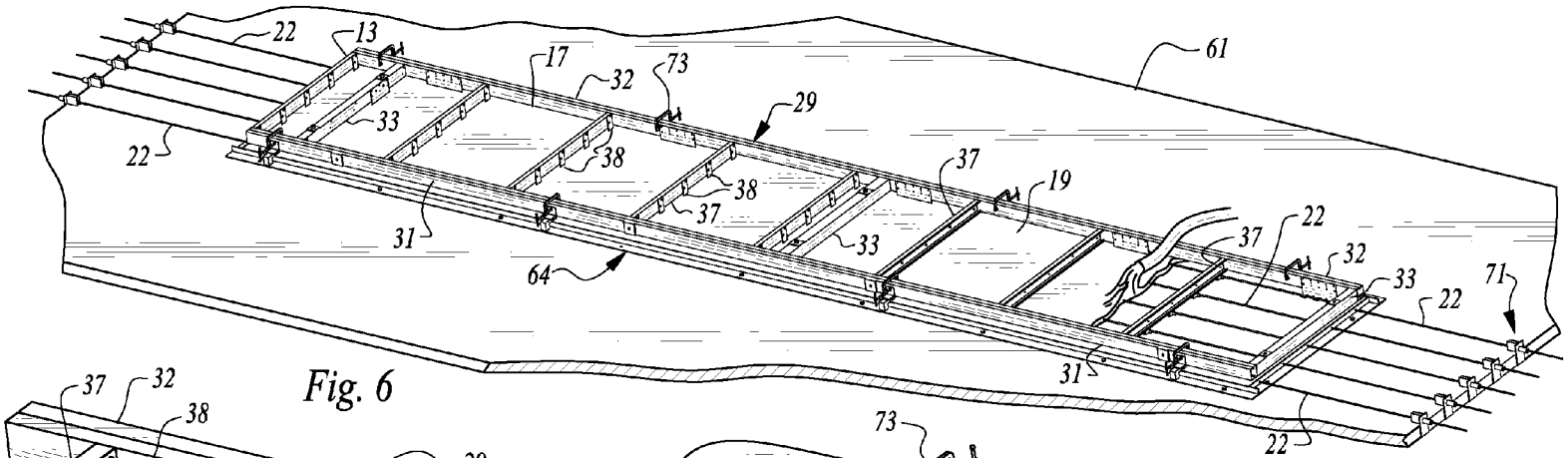
FIG. 6 is a perspective view as in FIG. 1, but showing concrete being poured into the slab form and over the forming surface.

Composite panel 11 also comprises a support frame 29, preferably manufactured from steel. Support frame 29 includes an upper chord 31 and a lower chord 32, as shown most clearly in FIGS. 1 and 6. The upper chord 31 and the lower chord 32 generally extend in parallel relation, from the first end 13 to the second end 14 of slab 12. Upper chord 31 is adjacent upper side 16 and lower chord 32 is adjacent lower side 17.

Support frame 29 also includes a plurality of tubular connection studs 33, extending transversely between upper chord 31 and lower chord 32. Each connection stud 33 includes one or more nuts 34, welded to its inwardly facing side. Nuts 34 are threadably engaged by other connectors, discussed below, to provide the principal means for interconnecting the support frame 29 with the support framework 36 of the building. In this way, both vertical and lateral loads of the panel 11 are transferred to the building structure. These nuts may readily be replaced with other equivalent connection means, including a threaded aperture in the connection stud itself, a threaded bolt, or by simply welding the connection stud 33 to the support framework 36.

Yet another aspect of support frame 29 comprises a plurality of C studs 37, extending vertically within frame 29 and transversely between upper chord 31 and lower chord 32, typically 48" on center. C studs 37 are preferably of a lighter gauge and smaller in cross-section than connection studs 33, but they are more numerous in frame 29 than the connection studs 33. The C studs 37 provide additional rigidity to frame 29, and also provide load transfer functions between slab 12 and frame 29. And, as will be explained more fully below, C studs 37 serve slab stripping and handling functions in the casting plant before the slab 12 has fully cured.

Composite panel 11 further comprises anchor means in the form of a plurality of anchors, extending from support frame 29 to pre-stressed cables 22. A covered portion of each anchor is cast in the concrete slab 12, and an exposed portion of each anchor extends outwardly from the slab 12, maintaining the support frame 29 in generally parallel, spaced relation from inner face 19 of slab 12.

Anchor means comprises flex anchor 38, shown particularly in FIGS. 18-21. Flex anchor 38 is preferably made from lighter 18 gauge steel, and is designed primarily for interconnection to C studs 37. Flex anchor 38 is generally elongated, having an upper exposed portion 39, and a lower covered portion 41. One or more apertures 42 are provided in exposed portion 39, for bolt or screw attachment to the closed side of a respective C stud 37, held in proximity to cable 22, at approximately 24" on center. Alternatively, exposed portion 39 may be welded directly to C stud 37.

Lower covered portion 41 includes a foot 43 and a slot 44. Foot 43 extends perpendicularly from one side of lower covered portion 41. Slot 44 is provided for proximate passage of a respective pre-stressed cable 22, shown in broken line in FIGS. 18-19. Each flex anchor 38 is positioned on a C stud 37 so the respective pre-stressed cable 22 lies perpendicular to the weak axis of the flex anchor 38, and the cable 22 passes through the slot 44 in the flex anchor. This placement of the flex anchor 38 allows for the prestressed concrete to shrink with minimal restraint when the pre-stressed cables 22 are severed at stripping time after the concrete has at least partially cured. Flex anchors 38 are secured to the support frame 29 prior to casting them in concrete, and are used for stripping and handling load transfers while the panel 11 is at the casting plant. (See, FIGS. 9 and 10). In so doing, flex anchors 38 transfer loading in a direction perpendicular to the plane of the slab 12, to and from the support frame 29 and the slab 12.

Anchor means also comprises gravity anchor 46, shown particularly in FIGS. 14-17. Gravity anchor 46 is preferably made from heavier 12 gauge steel, and is designed primarily for interconnection to connection studs 33. Gravity anchor 38 is generally elongated, having an upper exposed portion 47, and a lower covered portion 48. One or more apertures 49 are provided in exposed portion 47, for bolt or screw attachment to at least one side of a respective connection stud 33.

Figure 4:
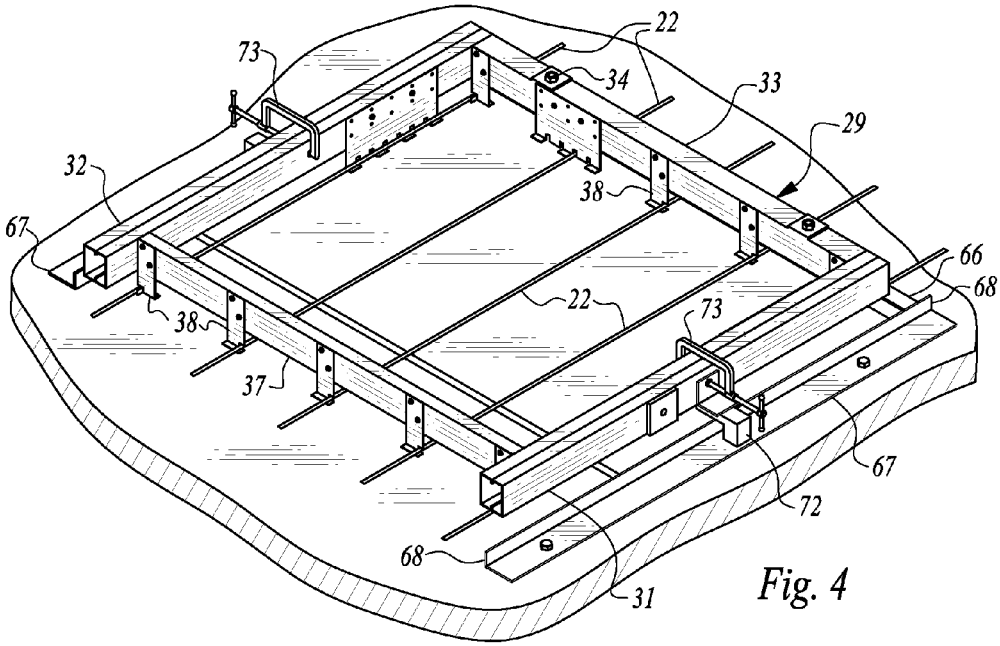
FIG. 4 is a detail perspective view showing the right-handed end of the assembled structure shown in FIG. 1.
Figure 5:
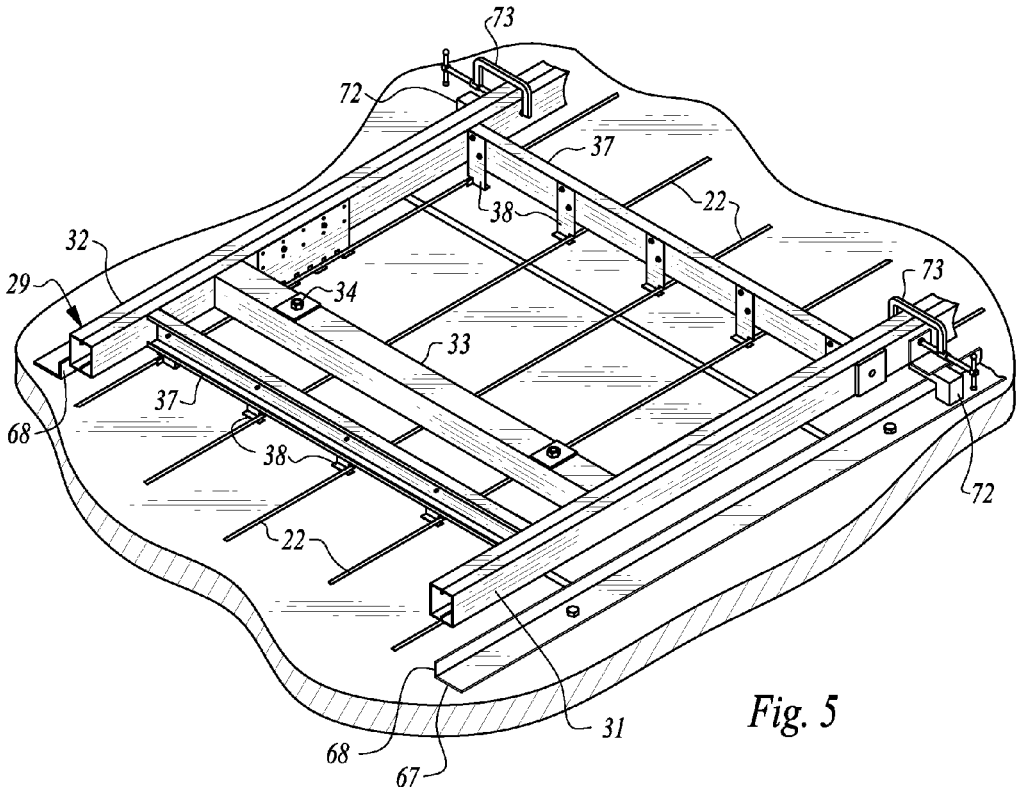
FIG. 5 is a detail perspective showing an intermediate portion of the assembled structure shown in FIG. 1.

In the embodiment shown, two of the connection studs 33 include only one gravity anchor 46, in the vicinity of the lower side 17 of slab 12. However, one of the connection studs 33 includes a single gravity anchor 46, and four flex anchors 38. (See, FIGS. 4 and 13). This is because a vertical line of flex anchors 38 is preferably located every 48" along support frame 29, and the design of composite panel 11 is such that a connection stud 33 is located at the end of the panel, 48" from the adjacent C stud 38. For that reason, the connection stud 33 at the end of the panel includes both a gravity anchor 46, and a plurality of flex anchors 38.

Lower covered portion 48 includes a plurality of feet 51 and a plurality of slots 52. Feet 51 extend perpendicularly from either side of covered portion 48. A selected one of slots 52 is used for proximate passage of a respective pre-stressed cable 22, shown in broken line in FIGS. 14-15. Each gravity anchor 46 is positioned on a connection stud 33 so the respective pre-stressed cable 22 lies perpendicular to the weak axis of the gravity anchor 46, and the cable 22 passes through one of the slots 52 in the gravity anchor 46.

This placement of the gravity anchors 46, with their strong axes vertically oriented, provides transfer of the vertical load of the slab 12 to support frame 29, and then to the support framework 36 of the building. Gravity anchors 46 are not required for panel stripping or yard handling duties, so they can be attached to the connection studs 33 after the concrete in slab 12 has fully cured.

Anchor means further comprises lateral anchor 53, shown particularly in FIGS. 22-25. Lateral anchor 53 is also preferably made from heavier 12 gauge steel, and is designed primarily for interconnection to upper chord 31 and lower chord 32. Lateral anchor 53 is generally elongated, having an upper exposed portion 54, and a lower covered portion 56. One or more apertures 57 are provided in exposed portion 54, for bolt or screw attachment to a respective upper chord 31 or a lower chord 32.

Lower covered portion 56 includes a plurality of feet 58 and a plurality of slots 59. Feet 58 extend perpendicularly from either side of covered portion 56. A selected side of covered portion 56 is used for interconnection with a respective pre-stressed cable 22. As shown in broken line in FIGS. 22-23, cable 22 lies over feet 58 and is in proximate relation with the stem of lower covered portion 56 as well. Each lateral anchor 53 is positioned along a chord 31 or 32, so the respective pre-stressed cable 22 lies parallel to the strong axis of the lateral anchor 46.

Figure 7:
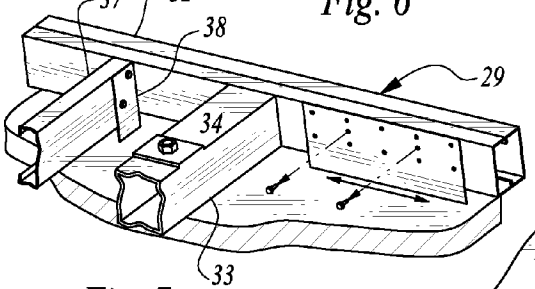
FIG. 7 is a fragmentary detail insert view of the slab, showing the upper chord, a connection stud, a C-stud, and a lateral anchor.

This placement of the lateral anchors 53 would restrain the pre-stressed concrete in slab 12 from shrinkage during the curing process, possibly causing flexure or cracking of the slab 12. For that reason, anchors 53 are not secured to the chords 31 and 32 until an appropriate cure time has passed. (See, FIG. 7) This cure time will vary with the mix, ambient temperatures, and particular curing practices. A minimum of 7 days curing time would be expected, and 28 days curing time would be common, before lateral anchors 53 are attached to the chords 31 and 32. The method of attachment can be through screw or bolt fasteners, or by welding, depending upon the load transfer requirements.

Owing to the placement and orientation of the lateral anchors 53, they are effective to transfer lateral loads to and from the elongated upper and lower chords 31 and 32 of the support frame 29, and the pre-stressed cables 22 passing through the same longitudinal aspect of slab 12. Lateral anchors 53 will also stiffen the flexural properties of the pre-stressed slab 12, between the connection points of the panel 11 to the building support framework 36, through shear transfer generated by flexure between the pre-stressed concrete slab 12 and the support frame 29.

With the foregoing explanation of its basic components and features in mind, the method of manufacturing the composite panel 11 can now be described. In the yard where the panel 11 is to be manufactured, a horizontal and generally planar forming surface 61 is provided. Forming surface 61 will typically be made from steel or concrete, which has been pre-treated with a release agent for use with concrete. Forming surface 61 may be smooth to produce a corresponding smooth surface to outer face 18 of slab 12. Or, forming surface may include three-dimensional features to produce mirror image three-dimensional features in outer face 18. By way of example only, grooves 23 may be produced by protruding slats 62 arranged on forming surface 61. Also, texturing 24 may be formed in outer face 18 by providing corresponding texturing 63 on forming surface 61. (See, FIG. 10).

A slab form 64 is also provided on forming surface 61, to define the configuration and dimensions of slab 12. Slab form 64 may be bolted to forming surface 61 as shown, or it may be spot welded for quick assembly and disassembly. Slab form 64 has opposing end portions 66 and opposing side portions 67 with walls 68 having a predetermined height. End portions 66 thereby define the first and second ends 13 and 14 of the slab 12, and side portions 67 defining the upper and lower sides 16 and 17 of the slab 12. End portions 66 also include a plurality of bores 69 for the passage of cables 22, the location and height of the bores corresponding to the desired location and height of the cables within the slab 12. It is generally preferred for the cables to be equally distributed through a transverse dimension of the slab 12, and approximately midway between the outer face 18 and the inner face 19. The height of the walls 68 generally defines the desired thickness for slab 12.

Preferably, a plurality of pre-stressed cables 22 extends across forming surface 61 within slab form 64. The ends of the cables 22 pass through a respective bore 69 in end portions 66, and extend to a conventional cable tensioning fixture 71. The cables 22 are pre-stressed to a predetermined tension through the use of calibrated gauges in accordance with established industry standards.

Next, the support frame 29 is moved into place, supported in parallel, spaced relation above forming surface 61 and generally overlying the outline of slab form 64. Support of the frame 29 may be accomplished in a variety of ways, but the disclosed means is a combination of brackets 72 and c-clamps 73. The lower end of each bracket 72 rests on the form 64, and the upper end of each bracket is held against the side of an upper chord 31 or a lower chord 32 by a respective c-clamp 73. The height of the support frame 29 is such that the lower edge of support frame 29 is always above the upper edge of the walls 68 of the slab form 64.

Following, the anchor means including flex anchors 38, gravity anchors 46, and lateral anchors 53 are installed in their respective locations engaged with respective portions of cables 22 as discussed above. Flex anchors 38 are screwed, bolted, or welded to C studs 37 while the other anchors remain unattached to support frame 29 until slab 12 has cured.

Concrete is then poured into the slab form 64 over forming surface 61 until the concrete generally fills the contained volume within the slab form 64 and reaches the height of the walls 68. Filling this volume immerses all of the pre-stressed cables 22 and the lower covered portions 41, 48, and 56 of each of the anchors, forming cementitious slab 12.

Figure 8:
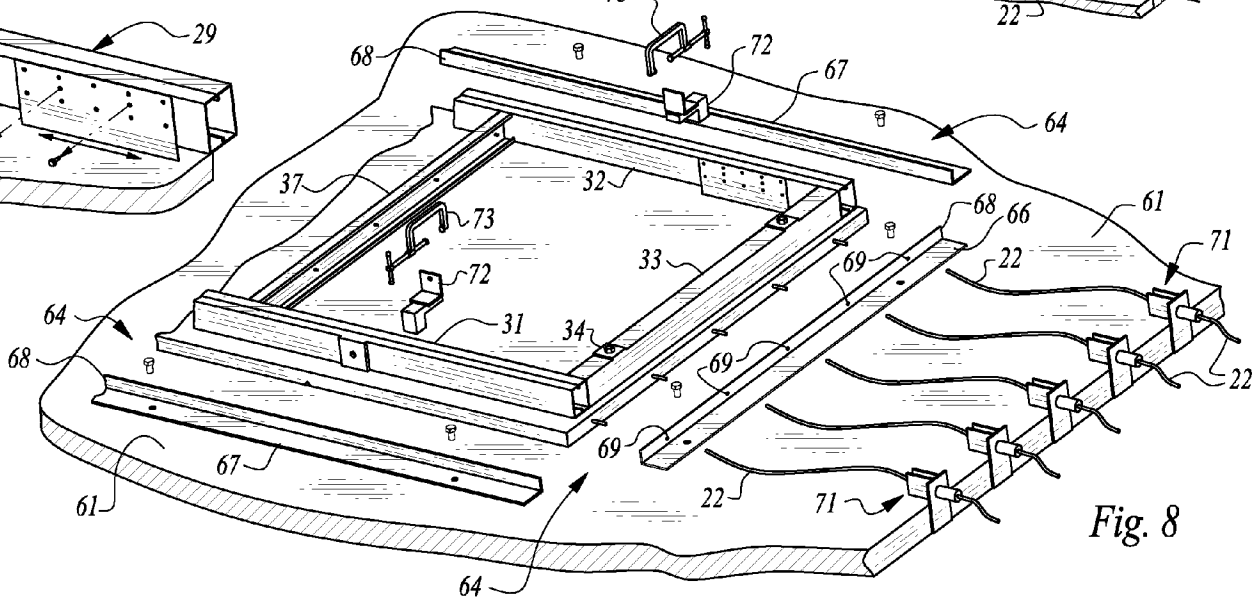
FIG. 8 is a fragmentary, exploded, perspective view showing one end of the slab with the slab form being removed and the pre-stressed cables severed from the slab.

After the slab 12 is partially cured, tension within the pre-stressed cables 22 is released and the cables 22 are severed, close to the bores 69. The c-clamps 73 are released, and the brackets 72 removed. Then, the entire slab form 64 is removed from the slab 12 and the forming surface 61, leaving the formed composite panel 11. (See, FIG. 8).

Figures 9, 10, 11, 12:
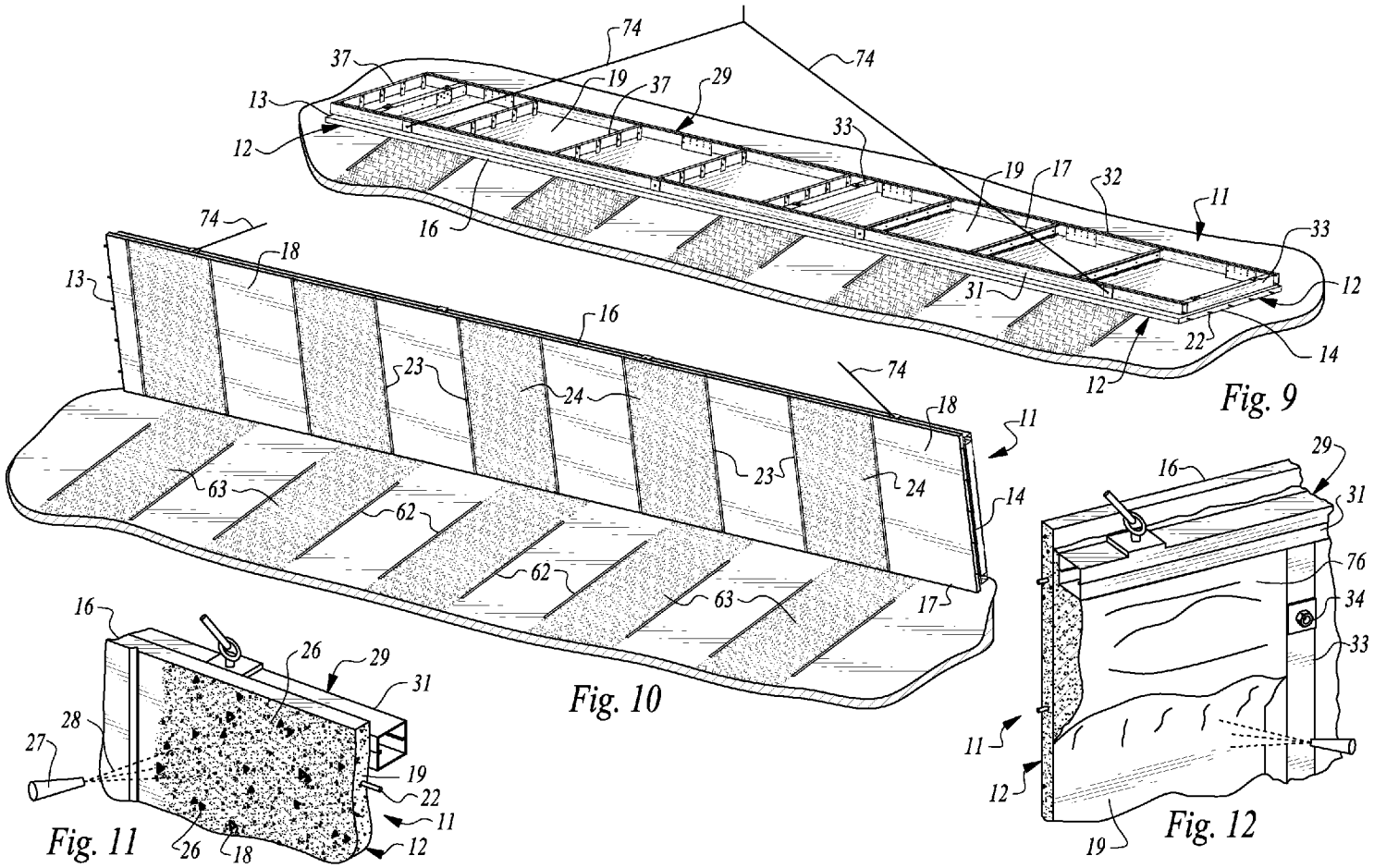
FIG. 9 is a perspective view showing the slab being lifted upwardly from the forming surface after curing.
FIG. 10 is a view as in FIG. 9, but with the slab into a nearly vertical position, showing the textured features of the forming surface impressed in the outer surface of the slab.
FIG. 11 is a detail insert view of further texturing being impressed on the outer surface of the slab through sand or water blasting.
FIG. 12 is a detail insert view of insulation being sprayed onto the inner surface of a cast slab.

Lifting cables 74 are attached to the upper chord 31, and the composite panel 11 may be raised as shown in FIGS. 9 and 10. The outer face 18 may be sandblasted, for additional texturing or effect, as previously described and shown in FIG. 11. Insulation 76 may also be spray applied to the inner face 19 of slab 12, as depicted in FIG. 12.

After the appropriate period of curing the concrete slab 12, the gravity anchors 46 are attached to the connector studs 33, and the lateral anchors 53 are attached to the upper chord 31 and the lower chord 31. The completed composite panel 11 is then ready to be transported to the building construction site for final assembly.

Figure 13:
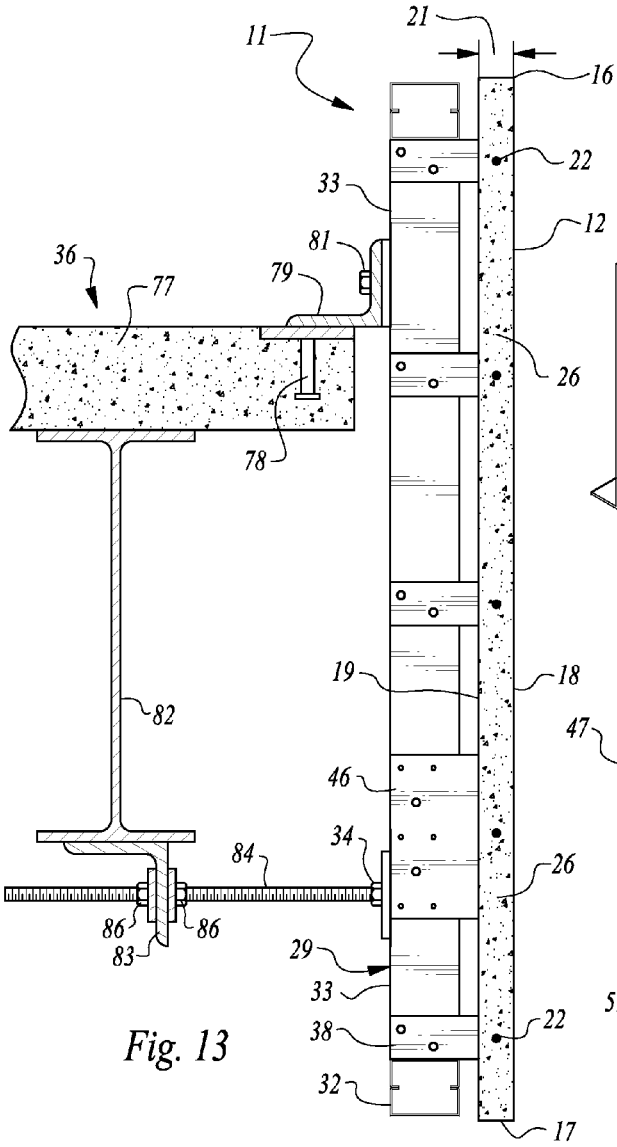
FIG. 13 is a fragmentary side elevational view of a slab attached to the supporting framework of a building.
Figure 14:
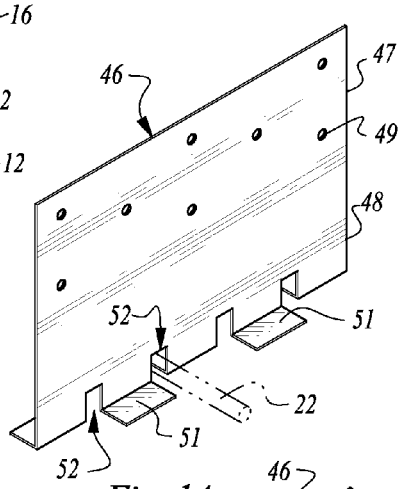
FIG. 14 is a perspective view of one side of a gravity anchor, showing the pre-stressed cable in broken line.
Figure 15:
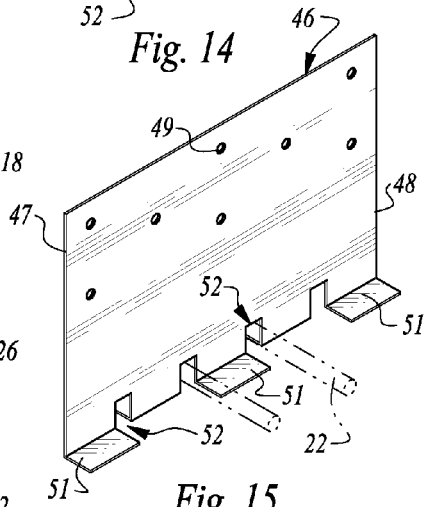
FIG. 15 is a perspective view of as in FIG. 14, but showing the other side of a gravity anchor.
Figure 17:
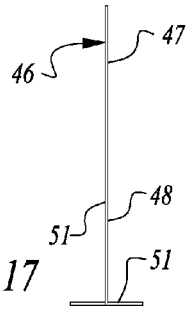
FIG. 17 is an end elevational view of a gravity anchor.
Figure 16:
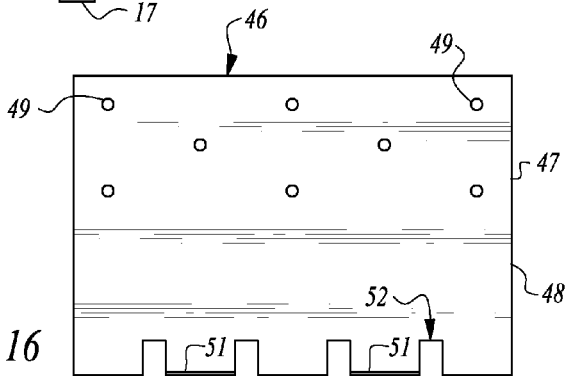
FIG. 16 is a side elevational view of a gravity anchor.
Figure 18:
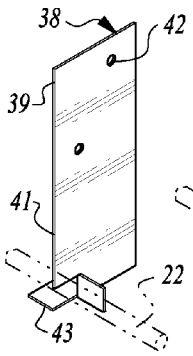
FIG. 18 is a perspective view of one side of a flex anchor, showing the pre-stressed cable in broken line.
Figure 19:
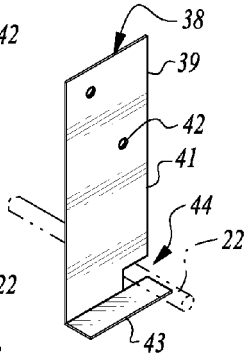
FIG. 19 is a perspective view as in FIG. 18, but showing the other side of the flex anchor.
Figure 22:
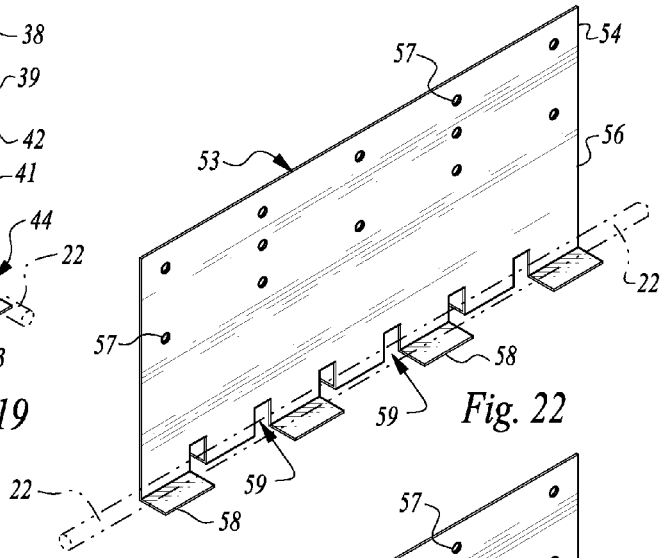
FIG. 22 is a perspective view of one side of a lateral anchor, showing the pre-stressed cable in broken line.
Figure 20:
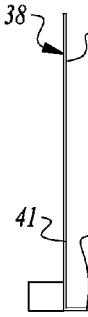
FIG. 20 is an end elevational view of a flex anchor.
Figure 21:
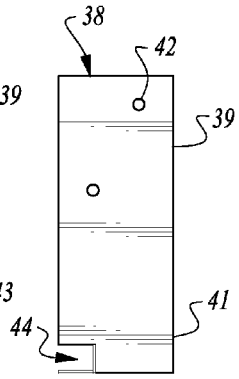
FIG. 21 is a side elevational view of a flex anchor.
Figure 23:
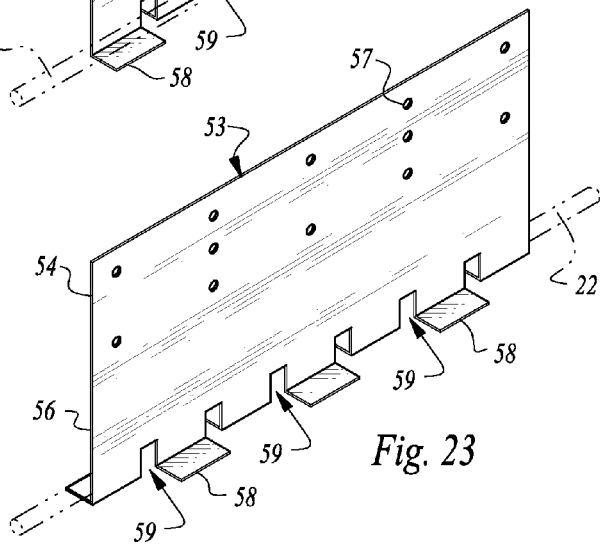
FIG. 23 is a perspective view as in FIG. 22, but showing the other side of the lateral anchor.
Figure 24:
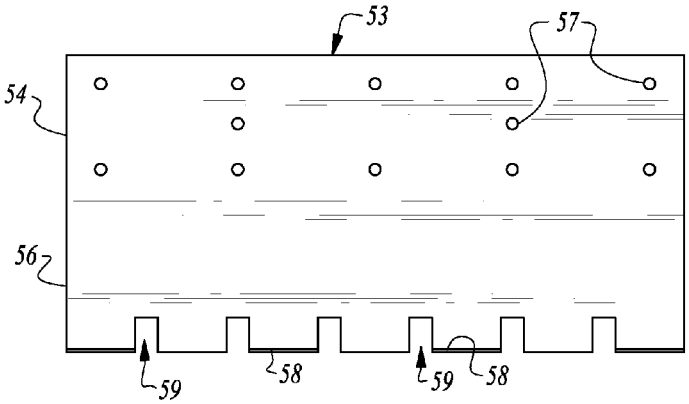
FIG. 24 is a side elevational view of a lateral anchor.
Figure 25:
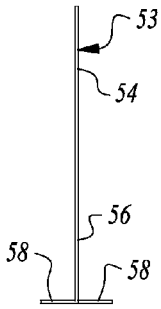
FIG. 25 is an end elevational view of a lateral anchor.

A typical but simplified installation of a composite panel 11 to a building support framework 36, is illustrated in FIG. 13. The support framework 36 includes a floor 77, cast with a footing 78 to which an angle bracket 79 is welded. A bolt 81 passes through bracket 79 and threadably engages a nut 34 welded to connector stud 33. An I-beam 82 is affixed to the lower side of floor 77, and includes a bracket 83 welded to its lower face. A threaded rod 84 is threadably engages nut 34, and is secured to either side of bracket 83 by means of nuts 86. It is apparent that the means of interconnecting panel 11 to support framework 36 can vary, but in all cases the object is effectively to transfer vertical and lateral loading between the two structures.

What is claimed is:

1. A composite panel, comprising:

a. an elongated concrete slab, said slab having a first end and a second end, an upper side and a lower side, and an outer face and an inner face defining a thickness for said slab, said slab further including a plurality of elongated pre-stressed cables passing through said slab and extending from said first end to said second end;

b. a support frame, said support frame including: an upper chord and a lower chord, said upper chord and said lower chord generally extending in parallel relation from said first end to said second end, said upper chord being adjacent said upper side and said lower chord being adjacent said lower side; and, a plurality of connection studs extending transversely between said upper chord and said lower chord;

c. a plurality of anchors extending from said support frame to said pre-stressed cables, a covered portion of said anchors being cast in said concrete slab, and an exposed portion of said anchors being attached to said support frame and extending away from said inner face of said slab, thereby maintaining said support frame in generally parallel spaced relation from said inner face of said slab.

2. A composite panel as in claim 1 in which said plurality of anchors includes at least one gravity anchor attached to a respective one of at least two of said connection studs.

3. A composite panel as in claim 1 in which said plurality of anchors includes includes at least one lateral anchor having a lower end of said covered portion adjacent a respective one of said chords.

4. A composite panel as in claim 1 in which said pre-stressed cables are located in the middle of said slab, approximately half-way between said outer face and said inner face.

5. A composite panel as in claim 1 in which said outer face includes three-dimensional features.

6. A composite panel as in claim 1 in which said inner face includes a layer of insulation.

7. A composite panel as in claim 1 further including a building provided with a lateral support structure, and in which said support frame is interconnected to said lateral support structure.

8. A composite panel as in claim 7 in which an inner side of said support frame provides a surface for interior finish attachment.

9. A composite panel as in claim 1 in which said support frame further includes a plurality of C studs, said C studs extending transversely between said upper chord and said lower chord, said plurality of anchors including at least one flex anchor attached to each of said C studs.

10. A composite panel as in claim 1 in which each of said anchors comprises a plate, said covered portion of each of said plates having at least one cable passageway and at least one laterally extending foot.

11. A composite panel, comprising:

a. an elongated concrete slab, said slab having a first end and a second end, an upper side and a lower side, and an outer face and an inner face defining a thickness for said slab, said slab further including at least one elongated pre-stressed cable passing through said slab and extending from said first end to said second end;

b. a support frame, said support frame including: an upper chord and a lower chord, said upper chord and said lower chord generally extending in parallel relation from said first end to said second end, said upper chord being adjacent said upper side and said lower chord being adjacent said lower side; and, a plurality of connection studs extending transversely between said upper chord and said lower chord;

c. anchor means for maintaining said support frame in generally parallel spaced relation from said inner face of said slab, said anchor means extending from said support frame to said pre-stressed cables, said anchor means further having an outer exposed portion being attached to said support frame and extending between said support frame and said inner face of said slab, and said anchor means further having an inner covered portion being cast in said concrete slab and extending between said inner face and a respective one of said pre-stressed cables.

12. A composite panel as in claim 11 in which said anchor means includes at least one gravity anchor attached to a respective one of at least two of said connection studs.

13. A composite panel as in claim 11 in which said anchor means includes includes at least one lateral anchor having a lower end of said covered portion adjacent a respective one of said chords.

14. A composite panel as in claim 11 in which said at least one pre-stressed cable is located in the middle of said slab, approximately half-way between said outer face and said inner face.

15. A composite panel as in claim 11 in which said outer face includes three-dimensional features.

16. A composite panel as in claim 11 further including a building provided with a lateral support structure, and in which said support frame is interconnected to said lateral support structure.

17. A composite panel as in claim 16 in which an inner side of said support frame provides a surface for interior finish attachment.

18. A composite panel as in claim 11 said support frame further includes a plurality of C studs, said C studs extending transversely between said upper chord and said lower chord, said plurality of anchors including at least one flex anchor attached to each of said C studs.

19. A composite panel as in claim 11 in which each of said anchors comprises a plate, said covered portion of each of said plates having at least one cable passageway and at least one laterally extending foot.

20. A method for manufacturing a composite panel, comprising the steps of:

a. providing a horizontal forming surface;

b. providing a slab form on an upper surface of said forming surface, said slab form having opposing end portions and opposing side portions with walls having a height, said end portions of said slab form further defining first and second ends of a slab, and said side portions of said slab form further defining upper and lower sides of a slab, and said height of said slab form generally defining a thickness for a slab;

c. providing at least one pre-stressed cable extending across said forming surface and having ends passing through said walls of said opposing end portions of said slab form;

d. providing a support frame, said support frame including: an upper chord and a lower chord, said upper chord and said lower chord generally extending in parallel relation from said first end to said second end of a slab, said upper chord being adjacent said upper side and said lower chord being adjacent said lower side of a slab; and, a plurality of connection studs extending transversely between said upper chord and said lower chord;

e. providing anchor means for maintaining said support frame in generally parallel spaced relation from an inner face of a slab, said anchor means having an outer exposed portion attached to at least one of said connection studs of said support frame and an inner covered portion proximate said at least one pre-stressed cable; and, f. pouring concrete into said slab form over said forming surface until the concrete generally fills a contained volume within said slab form and reaches said height of said walls, thereby immersing said at least one pre-stressed cable and said inner covered portion of said anchor means, forming a cementitious slab, said outer portion of said anchor means extending between said inner face of said slab and said support frame and being attached thereto.

21. A method as in claim 20, further including the steps of allowing said concrete to cure, severing ends of said at least one cable extending outside said walls of said slab form, and removing said slab form from said cementitious slab.

22. A method as in claim 20 further including providing a plurality of pre-stressed cables, extending in generally parallel fashion across said forming surface between said end portions, and having ends extending through respective walls of said end portions.

23. A method as in claim 20 in which said forming surface includes surface protrusions or recesses to form corresponding and respective recesses or protrusions in an outer surface of said cementitious slab.

24. A method as in claim 21, further including the step of spraying insulation over an inner surface of said cementitious slab, after said slab form is removed.

25. A composite panel, comprising:

a. an elongated concrete slab, said slab having a first end and a second end, an upper side and a lower side, and an outer face and an inner face defining a thickness for said slab, said slab further including a plurality of elongated pre-stressed cables passing through said slab and extending from said first end to said second end;

b. a support frame, said support frame including: an upper chord and a lower chord, said upper chord and said lower chord generally extending in parallel relation from said first end to said second end, said upper chord being adjacent said upper side and said lower chord being adjacent said lower side; a plurality of connection studs extending transversely between said upper chord and said lower chord; and, a plurality of C studs, said C studs extending transversely between said upper chord and said lower chord, said plurality of anchors including at least one flex anchor attached to each of said C studs; and, c. a plurality of anchors extending from said support frame to said pre-stressed cables, a covered portion of said anchors being cast in said concrete and an exposed portion of said anchors maintaining said support frame in generally parallel spaced relation from said inner face of said slab.

26. A composite panel, comprising:

a. an elongated concrete slab, said slab having a first end and a second end, an upper side and a lower side, and an outer face and an inner face defining a thickness for said slab, said slab further including at least one elongated pre-stressed cable passing through said slab and extending from said first end to said second end;

b. a support frame, said support frame including: an upper chord and a lower chord, said upper chord and said lower chord generally extending in parallel relation from said first end to said second end, said upper chord being adjacent said upper side and said lower chord being adjacent said lower side; a plurality of connection studs extending transversely between said upper chord and said lower chord; and, a plurality of C studs, said C studs extending transversely between said upper chord and said lower chord, said plurality of anchors including at least one flex anchor attached to each of said C studs; and, c. anchor means for maintaining said support frame in generally parallel spaced relation from said inner face of said slab, said anchor means extending from said support frame to said pre-stressed cables, an inner portion of said anchor means being cast in said concrete.

27. A method for manufacturing a composite panel, comprising the steps of:

a. providing a horizontal forming surface;

b. providing a slab form on an upper surface of said forming surface, said slab form having opposing end portions and opposing side portions with walls having a height, said end portions of said slab form further defining first and second ends of a slab, and said side portions of said slab form further defining upper and lower sides of a slab, and said height of said slab form generally defining a thickness for a slab;

c. providing at least one pre-stressed cable extending across said forming surface and having ends passing through said walls of said opposing end portions of said slab form;

d. providing a support frame, said support frame including: an upper chord and a lower chord, said upper chord and said lower chord generally extending in parallel relation from said first end to said second end of a slab, said upper chord being adjacent said upper side and said lower chord being adjacent said lower side of a slab; and, a plurality of connection studs extending transversely between said upper chord and said lower chord;

e. providing anchor means for maintaining said support frame in generally parallel spaced relation from an inner face of a slab, said anchor means having an outer portion attached to said support frame and an inner portion proximate said at least one pre-stressed cable;

f. pouring concrete into said slab form over said forming surface until the concrete generally fills a contained volume within said slab form and reaches said height of said walls, thereby immersing said at least one pre-stressed cable and said inner portion of said anchor means, forming a cementitious slab; and, g. allowing said concrete to cure, severing ends of said at least one cable extending outside said walls of said slab form, and removing said slab form from said cementitious slab.

* * * * *